US006925924B2

(12) United States Patent
Baker et al.

(10) Patent No.: US 6,925,924 B2
(45) Date of Patent: Aug. 9, 2005

(54) METHOD AND APPARATUS TO IMPROVE PERFORATING EFFECTIVENESS USING A UNIQUE MULTIPLE POINT INITIATED SHAPED CHARGE PERFORATOR

(75) Inventors: Ernest L. Baker, Wantage, NJ (US); David C. Daniel, Missouri City, TX (US); David S. Wesson, Ft. Worth, TX (US); John L. Burba, III, Boulder City, NV (US); Arthur S. Daniels, Rockaway, NJ (US); Robert E. Davis, Joshua, TX (US)

(73) Assignee: Molycorp Inc., Mountain Pass, CA (US)

( * ) Notice: Subject to any disclaimer, the term of this patent is extended or adjusted under 35 U.S.C. 154(b) by 0 days.

(21) Appl. No.: 10/684,858

(22) Filed: Oct. 14, 2003

(65) Prior Publication Data

US 2005/0115391 A1 Jun. 2, 2005

(51) Int. Cl.[7] ..... E21B 43/116
(52) U.S. Cl. ..... 87/1.151
(58) Field of Search ..... 89/1.151; 102/476, 102/307, 308, 300

(56) References Cited

U.S. PATENT DOCUMENTS

| | | | | |
|---|---|---|---|---|
| 3,100,445 | A * | 8/1963 | Poulter | 102/309 |
| 3,103,882 | A * | 9/1963 | Gilliland | 102/309 |
| 3,136,249 | A * | 6/1964 | Poulter | 102/309 |
| 3,443,518 | A | 5/1969 | Cross | 102/24 |
| 3,451,339 | A * | 6/1969 | Precoul | 102/476 |
| 3,658,007 | A * | 4/1972 | Bucklisch | 102/306 |
| 3,661,086 | A * | 5/1972 | Thomanek et al. | 102/476 |
| 3,662,684 | A * | 5/1972 | Bodinaux | 102/476 |
| 3,736,875 | A * | 6/1973 | Bucklishch | 102/309 |
| 3,802,342 | A * | 4/1974 | Berlot et al. | 102/309 |
| 4,111,126 | A * | 9/1978 | Thomanek | 102/476 |
| 4,594,946 | A * | 6/1986 | Ringel et al. | 102/307 |
| 4,594,947 | A * | 6/1986 | Aubry et al. | 102/307 |
| 4,665,826 | A * | 5/1987 | Marer | 102/401 |
| 4,672,896 | A * | 6/1987 | Precoul et al. | 102/309 |
| 4,711,181 | A * | 12/1987 | Ringel et al. | 102/476 |
| 4,784,062 | A * | 11/1988 | Rudolf et al. | 102/476 |
| 4,829,901 | A * | 5/1989 | Yates, Jr. | 102/306 |
| 4,860,655 | A | 8/1989 | Chawla | 102/306 |

(Continued)

FOREIGN PATENT DOCUMENTS

DE 3507062 C1 * 1/1986

*Primary Examiner*—Teri Pham Luu
*Assistant Examiner*—Jordan Lofdahl
(74) *Attorney, Agent, or Firm*—Yale S. Finkle; Gregory F. Wirzbicki

(57) ABSTRACT

A non-linear shaped charge perforator for use in perforating an oil and gas formation into which a wellbore has been drilled comprises a monolithic, axisymmetric metal case in which is disposed a main explosive charge between the front of the case, which is closed with a concave metal liner, and the closed back end of the case. The main explosive charge contains multiple initiation points, preferably two initiation points located about 180° apart on the outside surface of the charge, so that when the perforator is detonated the main charge is initiated such that the metal liner is collapsed into a non-circular jet, preferably a fan-shaped jet, that pierces the casing of the wellbore and forms non-circular perforations, preferably slot-shaped perforations, in the surrounding formation.

33 Claims, 3 Drawing Sheets

U.S. PATENT DOCUMENTS 5,204,493 A * 4/1993 Christmann et al. ..... 102/307
5,259,317 A * 11/1993 Lips ..... 102/307
5,322,020 A * 6/1994 Bernard et al. ..... 102/476
5,479,860 A 1/1996 Ellis ..... 102/313
5,564,499 A 10/1996 Willis et al. ..... 166/299
5,723,811 A * 3/1998 Bouet et al. ..... 102/476
5,792,977 A * 8/1998 Chawla ..... 102/307
5,792,980 A * 8/1998 Weimann ..... 102/476
6,167,811 B1 * 1/2001 Walters ..... 102/476
6,283,214 B1 9/2001 Guinot et al. ..... 166/297
6,378,438 B1 4/2002 Lussier et al. ..... 102/307
6,393,991 B1 5/2002 Funston et al. ..... 102/476
6,467,416 B1 * 10/2002 Daniels et al. ..... 102/476
2004/0107825 A1 * 6/2004 Kash ..... 89/1.15

* cited by examiner

METHOD AND APPARATUS TO IMPROVE PERFORATING EFFECTIVENESS USING A UNIQUE MULTIPLE POINT INITIATED SHAPED CHARGE PERFORATOR

BACKGROUND OF INVENTION

This invention relates generally to oilfield perforating and fracturing using explosive shaped charges and is particularly concerned with a method of forming non-circular perforations in hydrocarbon-bearing subterranean formations using a uniquely designed shaped charge perforator having multiple initiation points.

After a well has been drilled and casing has been cemented in the well, perforations are created in the casing, cement liner and surrounding formation to provide paths or tunnels in the formation through which oil and gas can flow toward the well, through the holes in the cement liner and casing and into the wellbore for transportation to the surface. These perforations are typically cylindrical or round holes made by conventional explosive shaped charge perforators. Usually, these perforators are tightly arranged in helical patterns around downhole tools called well perforators or perforating guns, which are lowered into the wellbore adjacent the target oil and gas producing formations. Once in place the shaped charges are detonated, thereby making multiple holes in the well casing, cement liner and surrounding target formation. In many cases hundreds of these charges are detonated sequentially in rapid succession to produce a large number of perforations that penetrate radially in all directions into the target formation.

Conventional shaped charge perforators typically include a cup-shaped metal case or housing having an open end, a high explosive charge disposed inside the case, and a thin concave metallic liner closing the open end. The case has a base portion that is configured to receive a detonator cord, which also is connected to the base portion of the other shaped charges so that a large number of charges can be detonated nearly simultaneously. Each shaped charge is typically detonated by initiating the explosive charge with the detonating cord at a single location at the back of the base portion of the case, usually at a point on the central horizontal axis of the case. The resultant detonation wave collapses the metal liner to form a forward moving high velocity jet that travels out of the open end of the case. The jet is a highly focused metal penetrator in which all the energy is focused in a single line. The jet, traveling at speeds on the order of about 7 km/s, pierces the well casing and the cement liner and forms a cylindrical tunnel in the surrounding target formation. Conventional shaped charge perforators usually produce circular tunnels having a diameter typically less than about one inch.

After holes have been formed by the shaped charge perforators in the formation, a highly viscous fracturing fluid containing a propping agent is often pumped into the formation to hydraulically fracture the rock and prop the fractures open, thereby creating a permeable flow path through which oil and gas can enter the wellbore. A typical problem often encountered when fracturing through the circular tunnels made by conventional shaped charge perforators is that the circular holes have a tendency to bridge with the propping agents causing what is known as "screen-outs" to occur in the fracturing process. These "screen outs" frequently cause the fracturing treatment to be halted. It is known that circular hole diameters must be at least six times the median proppant diameter to avoid bridging and the resultant "screen outs" that create operational problems. It is also known that, if the holes created in the formation are in the shape of a slot, the width of the slot must only be 2.5 to 3 times the median proppant diameter to avoid bridging by the propping agent. The smaller perforation requirement of the slot results in penetrations that may expose greater formation surface, thereby increasing production. Also, for a given slot width, a larger proppant can be used to create more permeable fractures that allow for easier oil and gas flow.

It has been proposed to create slotted perforations in oil and gas formations by using linear shaped charges to create the perforations. However, the use of prior art linear shaped charges has several disadvantages. First, because of geometry, the linear jets produced by such charges produce poor formation penetration. Second, the tools used for producing linear jets are very different from conventional designs and therefore require additional training of personnel and increase the probability of expensive mistakes. Finally, the perforator guns for carrying the linear charges are very complex and create the potential for mechanical failure that could result in expensive repairs or even loss of the well.

It is clear from the above discussion that a method for creating linear or slotted perforations using explosive shaped charge perforators of a more conventional design as compared to that of a linear shaped charge is desirable.

SUMMARY OF THE INVENTION

In accordance with the invention, it has now been found that linear and other non-circular perforations can be made in subterranean hydrocarbon-bearing formations surrounding a wellbore by detonating in the wellbore uniquely designed, non-linear, shaped charge perforators having multiple initiation points. The shaped charge perforator of the invention is comprised of a single, non-linear axisymmetric case having side walls, an open front end and a closed back end. A main explosive charge comprised of a high explosive fills the hollow cavity defined by the side walls and closed back end, and a jet-producing axisymmetric metal liner closes the open front end of the case. The explosive charge has a back and sides that are flush with and conform to the shape of the interior of the case defined by the closed back end and side walls and a front that is flush with and conforms to the shape of the inside surface of the liner. The shaped charge perforator is also designed to have two or more initiation points for the main explosive charge. The initiation points are usually located on the main explosive charge such that, when the shaped charge perforator is detonated, the liner is formed into a jet at least a portion of which has a shape that enables the jet to penetrate the hydrocarbon-bearing formation in such a manner as to produce non-circular perforations in the formation.

In a preferred embodiment of the invention, the shaped charge perforator contains only two initiation points for the main explosive charge. These initiation points are usually both located on either the back or sides of the main explosive charge between about 165° and about 195° apart, preferably about 180° apart, in a plane perpendicular to the central horizontal axis of the shaped charge perforator. When initiation of the main explosive charge takes place at these points, the resultant detonation wave collapses the metal liner into a jet having at least a portion in the shape of a hand fan. This fan-shaped jet produces a linear or slotted perforation in the casing, the cement liner and the hydrocarbon-bearing formation surrounding the wellbore.

A booster explosive, which may be the same or different from the high explosive comprising the main explosive charge, is usually used to initiate the main explosive charge. The booster explosive occupies two or more passageways in the walls of the axisymmetric monolithic case. These passageways run from the rear of the closed back end of the case to the interior of the case such that the booster explosive filling the passageways communicates, typically by direct contact, with the main explosive charge at its desired initiation points. The booster explosive is then initiated, usually using a detonator cord, at the point or points in the rear of the closed back end of the case where the passageways originate. The detonation waves resulting from the initiation of the booster explosive travel through the separate passageways in the walls of the case until they reach the points where the booster explosive in each passageway communicates with the main explosive charge. Here, the detonation waves initiate the main explosive charge, and the liner is collapsed forming a forward moving fan-shaped jet.

The slot-shaped perforations formed utilizing the shaped charge perforators of the invention minimize the potential for bridging during fracturing treatments, thereby increasing the effectiveness of the treatments and decreasing the mechanical risks involved with such treatments. Since the perforators of the invention are non-linear and have a more conventional exterior configuration than linear shaped charges, they can be easily adapted for use with current oilfield perforating equipment thus eliminating the need to retrain personnel in their use. In addition, the fan-shaped jets produced by the inventive perforators may expose more formation surface area and produce less formation damage than the circular jets that are formed by conventional shaped charge perforators. This, in turn, will result in increased flows of oil and gas through the perforations into the wellbore.

BRIEF DESCRIPTION OF THE DRAWINGS

All identical reference numerals in the figures of the drawings refer to the same or similar elements.

DETAILED DESCRIPTION OF THE INVENTION

Figure 1:
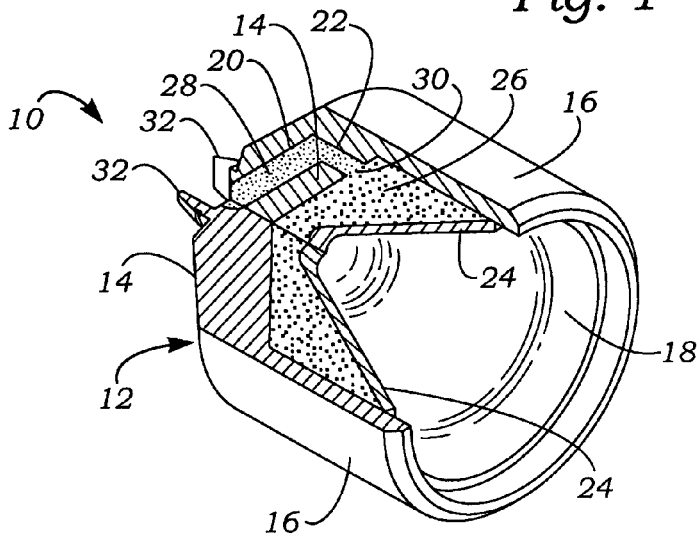
FIG. 1 in the drawings is an isometric view with a 90° cutaway taken along the line 1—1 in FIG. 2 showing one embodiment of a shaped charge perforator of the invention having two initiation points on the main explosive charge.
Figure 2:
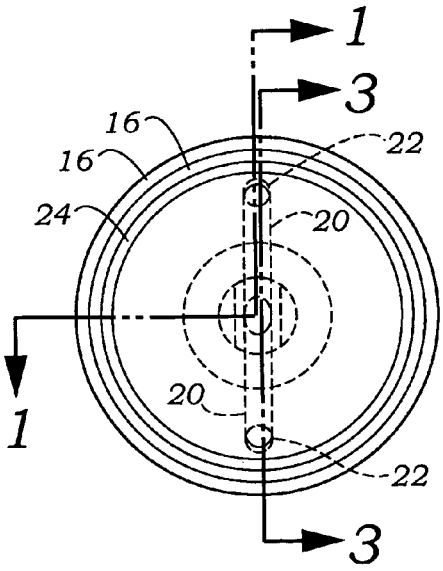
FIG. 2 is a front view of the shaped charge perforator of the invention shown in FIG. 1.

FIGS. 1–6 in the drawings illustrate one embodiment of the explosive non-linear shaped charge perforator of the invention designated by reference numeral 10. Normally, a plurality of these shaped charges, usually between about 10 and about 1,000 and preferably between about 30 and about 200, are mounted in a helical fashion around the charge tube of a perforating gun, not shown in the drawings, and are conductively coupled together by a detonator cord, which also is not shown in the drawing. The perforating gun is lowered into the casing of a well that has been drilled into a hydrocarbon-bearing formation so that the shaped charge perforators can be detonated to form perforations in the casing, the cement liner between the outside of the casing and the formation, and in the formation itself. The detonator cord is initiated by a blasting cap that is activated by an electrical signal generated at the surface of the well, and the resultant detonation wave initiates the individual explosive shaped charge perforators 10 in the perforating gun as it travels through the detonator cord. The non-linear shaped charge perforators 10 can be designed and arranged on the perforating gun so as to penetrate the hydrocarbon-bearing target formation with substantially non-circular perforations symmetrically in all directions or, if desired, in a preselected plane or planes.

The non-linear shaped charge perforator 10 shown in FIGS. 1–6 comprises a single, monolithic axisymmetric metal case 12 having a closed back end 14, side walls 16 and an open front end 18 that define a hollow interior. The case is preferably made of steel, but may be made with other metals, such as aluminum or zinc. As shown in FIGS. 1–6, the outside of case 12 is generally cup-shaped, but can take any shape which allows it to be easily used with a conventional perforating gun. Normally, the case will not have an elliptical profile. The shape of the interior of the case can be, among others, conical, bi-conical, tulip, hemispherical, trumpet, bell-shaped, hyperboloid, hyperbolic-paraboloid, cylindrical and parabolic. In addition, the interior shape can be a combination of the shapes mentioned above. For example, the interior shape of the embodiment of the invention shown in FIGS. 1–6 is a combination of a cone with that of a cylinder.

The case 12 contains two passageways comprised of pathways 20 and 22 that have been drilled into the solid walls of case 12. The pathways 20 extend from the center rear of closed back end 14 through its walls upward and downward at about a 45° angle from the central horizontal axis 11 (FIG. 3) of perforator 10. These pathways 20 intersect and communicate with pathways 22 in the walls of side walls 16, which pathways run parallel to the central horizontal axis of the perforator. The pathways 22 intersect and communicate with the hollow interior of the case 12 formed by the inside surfaces of closed back end 14 and side walls 16.

The open end 18 of shaped charge perforator 10 is closed with a concave metallic liner 24, which usually has a shape selected from, among others, conical, bi-conical, tulip, hemispherical, trumpet, bell-shaped, hyperboloid, hyperbolic-paraboloid and parabolic. Although the liner 24 shown in FIGS. 1–6 is in the single shape of a cone, it will be understood that the liner could comprise a combination of the above-mentioned shapes. The liner is preferably formed from a homogeneous mixture of compressed powdered metal held together with a small percentage of a binder material, which can be, among others, a polymer or a metal such as bismuth or lead. The powdered metal used to form the liner is usually selected from the group consisting of copper, tungsten, lead, nickel, tin, molybdenum and mixtures thereof. In some cases the liner may be machined from a solid piece of metal instead of being made by compressing powdered metal.

The hollow interior of case 12 formed by closed back end 14, side walls 16 and the inside surface of liner 24 is filled with a high explosive material which is compressed together to form a main explosive charge 26. The high explosive material may be RDX, HMX, HNS, PYX, NONA, ONT, TATB, HNIW, TNAZ, PYX, NONA, BRX, PETN, CL-20, NL-11 or another suitable explosive known in the art. A booster explosive 28 fills the pathways 20 and 22 in the walls of case 12. The booster explosive may be the same as or different from high explosive comprising main explosive charge 26 and is usually chosen from the group of explosives listed above. The booster explosive typically contacts the back surface of the main explosive charge at two locations or initiation points 30 that are between about 165° and about 195°, preferably between about 170° and 190° and most preferably about 180°, apart on the back of the main explosive charge. These initiation points preferably lie in a single plane perpendicular to the central horizontal axis 11 of perforator 10. The interior portion of the case typically contains only the main explosive charge and is normally devoid of wave shapers, deflectors, inserts, inner cases and the like. However, for specific design purposes, there may be a situation where the interior of the case may contain one of these items.

It has now been found that detonating a non-linear shaped charge perforator 10 of the invention in a wellbore drilled into a hydrocarbon-bearing subterranean formation by initiating the main explosive charge at two locations or points about 180° apart on the outside surface of the back or sides of the charge will collapse the liner 24 to form a fan-shaped jet that produces slot-shaped holes or perforations in the surrounding formation. Holes of this shape are preferable to the circular holes produced by shaped charge perforators whose main explosive charge is initiated at a single point located at its center rear or apex, or at multiple points distributed symmetrically about its outside surface or periphery, to form a generally circular jet. These slot-shaped or linear perforations do not bridge as easily as the round holes formed by circular shaped jets and may expose more formation surface area with less formation damage, thereby resulting in higher flows of oil and gas into the wellbore.

Once the non-linear shaped charge perforator 10 is coupled together with a detonator cord or other detonating device to other similar perforators in a perforating gun and the gun is lowered into its desired position in a wellbore, the blasting cap on the detonator cord is activated by an electrical signal. The blasting cap initiates the explosive in the detonator cord, which is attached to each perforator through the prongs 32 on the outside of closed back end 14, and the resultant detonation wave traveling through the detonator cord initiates the booster explosive at a single location at the rear center of the closed back end 14 of each perforator. The detonation waves created by the booster explosive travel through the two pathways 20 and then through the booster explosive in the two pathways 22 until they reach the initiation points 30 located about 180° apart on the back of main explosive charge 26. Detonation of the main explosive charge is then initiated at these two locations to produce detonation waves that collapse liner 24 to form a high velocity jet that travels forward usually between about 7.0 and about 11 km/s. The forward traveling jet leaves the open end of the perforator in the form of a highly focused metal penetrator having a shape similar to that of a hand fan. This jet, after it penetrates the wellbore casing and cement liner, produces slot-like or substantially linear perforations in the surrounding formation.

It is desirable that the perforations made in the formation be substantially linear having an aspect ratio greater than about 1.5, preferably greater than about 2.0, and that the perforation tunnels be straight, deep and undamaged. In order to obtain these optimum results, the jet produced by detonation of each shaped charge perforator should be substantially fan-shaped when viewed in cross section perpendicular to the plane in which the jet is broadest. To obtain such a jet, it is normally preferred that the main explosive charge be initiated at only two points about 180° apart in a single plane perpendicular to the central horizontal axis of the perforator. It will be understood, however, that linear perforations can be obtained by initiating the main charge at more than two points, e.g. three or four points, and that noncircular perforations of different shapes may also result in increased production of oil and gas and can be made by initiating the main charge at more than two points.

The actual size of the slot-like perforations and the resultant tunnels formed in oil and gas formations utilizing the non-linear shaped charge perforators of the invention can be varied by varying the location of initiation points on the outside surface of the back and/or sides of the main explosive charge 26. Typically, if the two initiation points are about 180° apart on the back of the explosive charge, locating them close together on the back will yield a narrow fan-shaped jet that produces a slot-like perforation having a small aspect ratio and relatively long length, while moving the points further apart on the back of the charge will result in a wider fan-shaped jet that will produce a slot-like perforation having a larger aspect ratio and shorter length. If one of the initiation points is moved from the back of the explosive charge to the rear of one of the sides of the explosive charge and the other is moved from the back to the rear of the opposite side of the explosive charge, an even wider fan-shaped jet will be produced and in turn will produce a perforation having an even larger aspect ratio. Moving the points of initiation forward on the sides of the charge toward the middle and then toward the front will typically result in an increasingly wider fan-shaped jet, which in turn will produce a slot-like perforation having a larger aspect ratio and shorter tunnel.

In the embodiments of the invention described above, the main explosive charge of the shaped charge perforator of the invention is initiated at two points by a booster explosive that is detonated in one place by use of a detonator cord. It will be understood that initiation of the main charge can be carried out directly with a detonator cord without the use of a booster explosive. Alternatively, an electronic detonator may be used to initiate either the booster explosive or the main charge in lieu of a detonator cord. Also, instead of being initiated at two single initiation points located about 180° apart on its back or sides, the main explosive charge can be initiated at a cluster of points, e.g. 2, 3 or 4 points, located in close proximity to each other with each cluster being located about 180° apart on the main explosive charge.

Figure 7:
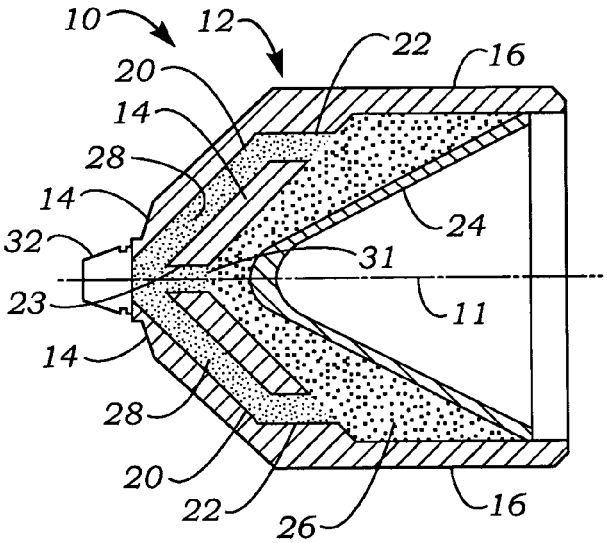
FIG. 7 is a cross-sectional elevation view of a shaped charge perforator of the invention similar to that shown in FIG. 3 but having three initiation points on the main explosive charge.
Figure 8:
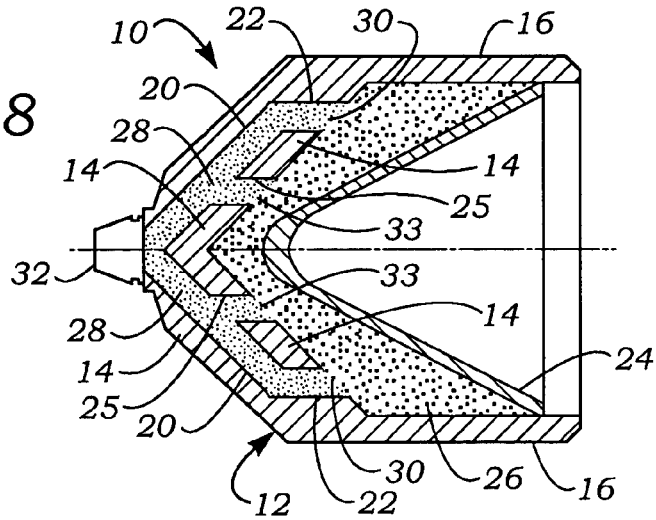
FIG. 8 is a cross-sectional elevation view of a shaped charge perforator of the invention similar to that shown in FIG. 3 but having four initiation points on the main explosive charge.

FIGS. 7 and 8 in the drawings illustrate embodiments of the invention similar to the one shown in FIGS. 1–6 but differing in the number of initiation points on the main explosive charge. The embodiment of the shaped charge perforator of the invention shown in FIG. 7 is similar to the one shown in FIG. 3 but differs in having a third initiation point 31 located on the back of the main explosive charge 26 at a point near the central horizontal axis 11 of perforator 10. This third point on the main explosive charge is initiated by the booster explosive 28 that fills passageway 23, which runs through the wall of closed back end 14 along the central horizontal axis 11 of the perforator.

Figure 3:
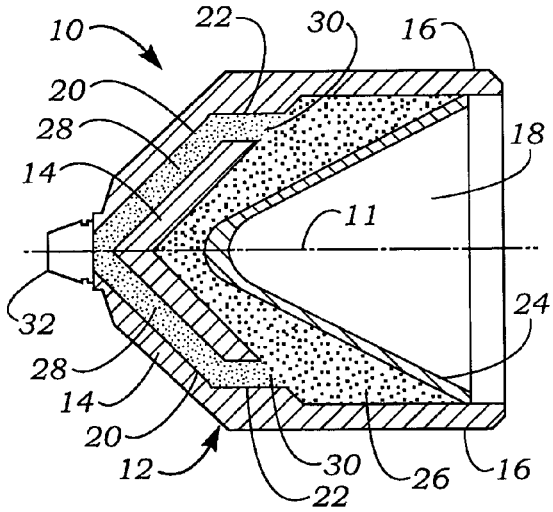
FIG. 3 is a cross-sectional elevation view of the shaped charge perforator of the invention shown in FIGS. 1 and 2 taken along the line 3—3 in FIG. 2.
Figure 4:
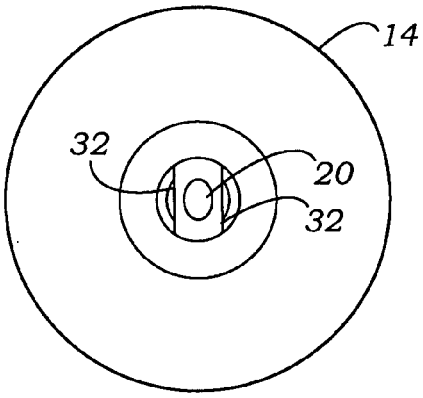
FIG. 4 is an end view of the shaped charge perforator of the invention shown in FIGS. 1 and 3.
Figure 5:
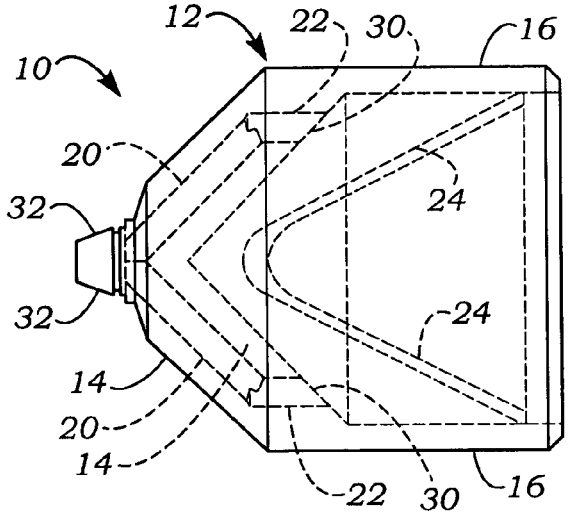
FIG. 5 is a side elevation view of the shaped charge perforator of the invention shown in FIGS. 1 and 3.
Figure 6:
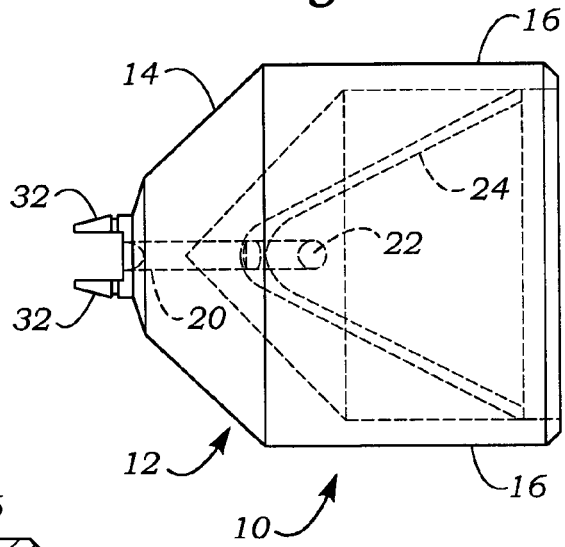
FIG. 6 is a side elevation view of the shaped charge perforator of the invention shown in FIG. 5 after it has been rotated 90°.

The embodiment of the shaped charge perforator of the invention shown in FIG. 8 is similar to the one shown in FIGS. 3 and 7 but differs in having two pair of initiation points 30 and 33, i.e., four initiation points. The initiation points in each pair are located about 180° apart on the back of main explosive charge 26. The additional initiation points 33 are initiated by the booster explosive 28 that fills passageways 25, which, like pathways 20, run through the wall of closed back end 14. The two initiation points 33 are located closer together on the back side of the main explosive charge than are the initiation points 30.

Figure 9:
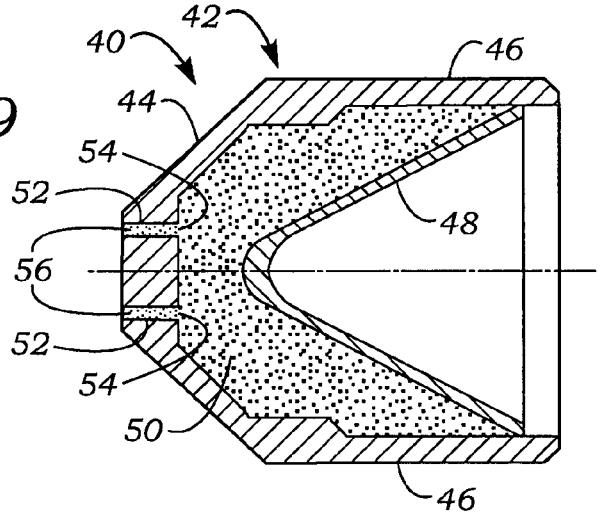
FIG. 9 is a cross-sectional elevation view of an alternate embodiment of the shape charge perforator of the invention having two initiation points on the main explosive charge.

An alternative embodiment of the non-linear shaped charge perforator of the invention is illustrated in FIG. 9 and identified by reference numeral 40. Like perforator 10 shown in FIG. 3, perforator 40 comprises a case 42 having a closed back end 44 and side walls 46 that form a hollow interior with an open end. A liner 48 is disposed within the hollow interior and closes the open end. A main explosive charge 50 comprised of a high explosive material fills the hollow interior of the perforator and conforms to and is flush with the inside surface of liner 48. Two passageways 52 in the back of the closed end 44 of the case 42 run from the outside rear surface of the case through the walls of the closed back end and communicate with the back of the main explosive charge 50 at two initiation points 54. The passageways are filled with a booster explosive 56 that contacts the main explosive charge at the initiation points 54.

The perforator 40 is detonated by initiating the booster explosive 56 at the rear of each passageway 52, usually by use of a detonator cord, not shown in the drawing, that is in contact with the back end of each passageway. The detonation waves thereby produced travel through the passageways 52 to the initiation points 54 on the back of main explosive charge 50. Here, the main explosive charge is initiated to form detonation waves that collapse liner into a fan-shaped jet.

Figure 10:
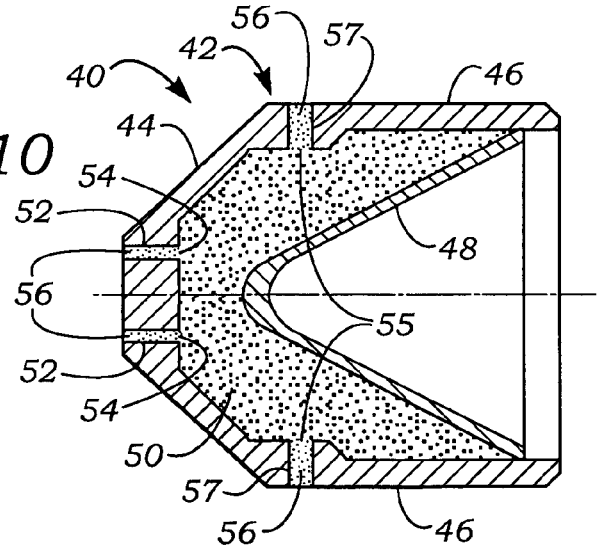
FIG. 10 is a cross-sectional elevation view of a shaped charge perforator of the invention similar to that of FIG. 9 but having four initiation points on the main explosive charge.

FIG. 10 in the drawings illustrates an embodiment of the invention similar to that shown in FIG. 9 but differing in that there are, in addition to the two initiation points 54 on the back of main explosive charge 50, an additional two initiation points 55 on the sides of the main explosive charge. The additional initiation points 55 are initiated by the booster explosive 56 that fills passageways 57, which run through the walls of sides 46 of perforator 40. Like initiation points 54 on the back of main explosive charge, initiation points 55 are located between about 165° and 195°, preferably about 180°, apart in a plane perpendicular to the central horizontal axis of the perforator.

In the embodiments of the invention described above, the main explosive charge of the shaped charge perforator of the invention is initiated at two or more points in order to form a fan-shaped jet that produces substantially linear perforations in the target formation. It will be understood, however, that initiation at two or more points can also be used to produce non-circular perforations of shapes other than linear. In such cases the initiations points are usually distributed about the exterior of the main explosive charge such that on simultaneous initiation at the multiple points a non-circular shaped jet is formed as opposed to a circular shaped jet.

Although this invention has been described by reference to several embodiments and to the figures in the drawing, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

We claim:

1. A method for forming perforations in a subterranean hydrocarbon-bearing formation surrounding a wellbore using a non-linear, shaped charge perforator, said method comprising:

(a) placing said non-linear, shaped charge perforator in said wellbore, said shaped charge perforator comprising (1) a single, axisymmetric case having a hollow interior, an open front end, side walls, and a closed back end, (2) a jet-producing, axisymmetric liner disposed within said axisymmetric case and closing said open front end and (3) a main explosive charge disposed within said hollow interior between said liner and the closed back end of said axisymmetric case, wherein said main explosive charge has a back that conforms to and is substantially flush with said closed back end, sides that conform to and are substantially flush with said side walls, and a front that conforms to and is substantially flush with said liner; and (b) detonating said non-linear, shaped charge perforator by initiating said main explosive charge at at least two points between about 165° and about 195° apart such that said liner is formed into a jet that penetrates said hydrocarbon-bearing formation.

2. The method defined by claim 1 wherein said main explosive charge is initiated at two points on its outside surface between about 165° and about 195° apart.

3. The method defined by claim 2 wherein said points of initiation are in a single plane perpendicular to the central horizontal axis of said shaped charge perforator.

4. The method defined by claim 2 wherein said main explosive charge is initiated at two points between about 165° and about 195° part on said back of said main explosive charge.

5. The method defined by claim 2 wherein said main explosive charge is initiated at two points between about 165° and about 195° apart on said sides of said main explosive charge.

6. The method defined by claim 5 wherein said initiation points are located on said sides near the back of said main explosive charge.

7. The method defined by claim 5 wherein said initiation points are located on said sides near the middle of said main explosive charge.

8. The method defined by claim 5 wherein said initiation points are located on said sides near the front of said main explosive charge.

9. The method defined by claim 2 wherein said axisymmetric liner comprises a shape selected from the group consisting of conical, bi-conical, tulip, hemispherical, trumpet, bell-shaped, hyperboloid, hyperbolic-paraboloid and parabolic.

10. The method defined by claim 2 wherein said axisymmetric case comprises an interior shape selected from the group consisting of conical, bi-conical, tulip, hemispherical, trumpet, bell-shaped, hyperboloid, hyperbolic-paraboloid, cylindrical and parabolic.

11. The method defined by claim 2 wherein said axisymmetric liner is substantially in the shape of a cone and the interior of said axisymmetric case is partially in the shape of a cone and partially in the shape of a cylinder.

12. The method defined by claim 2 wherein said jet penetrates said hydrocarbon-bearing formation in such a manner as to form perforations substantially in the shape of a slot.

13. The method defined by claim 12 wherein said perforations are the shape of a substantially linear slot.

14. The method defined by claim 12 wherein said slot has an aspect ratio greater than about 1.5.

15. The method defined by claim 2 wherein said main explosive charge is simultaneously initiated at said two points by separate electronic detonators.

16. The method defined by claim 2 wherein said main explosive charge is simultaneously initiated at said two points by a booster explosive that is initiated at a single point.

17. The method defined by claim 2 wherein said initiation of said main explosive charge is carried out at said two points and there is initiation at no other point.

18. The method defined by claim 1 wherein said main explosive charge is initiated simultaneously at two or more points.

19. The method defined by claim 2 wherein said initiation of said main explosive charge is carried out at said two points and there is no initiation at the back of said main explosive charge on the central horizontal axis of said shaped charge perforator.

20. A method for forming substantially linear perforations in a subterranean hydrocarbon-bearing formation surrounding a wellbore using a non-linear, shaped charge perforator, said method comprising:

(a) placing said non-linear, shaped charge perforator in said wellbore, said shaped charge perforator comprising (1) a single case having a hollow interior, an open front end and a closed back end, (2) a jet-producing liner disposed within said case and closing said open end and (3) a main explosive charge disposed within said hollow interior between said liner and the closed back end of said case, wherein said main explosive charge has a back that conforms to and is substantially flush with said closed back end, sides that conform to and are substantially flush with said side walls, and a front that conforms to and is substantially flush with said liner; and (b) detonating said non-linear, shaped charge perforator by initiating said main explosive charge at two points between about 165° and about 195° apart on the outside surface of said main explosive charge such that said liner is formed into a jet that penetrates said hydrocarbon-bearing formation in such a manner as to make a substantially linear perforation in said formation, wherein said main explosive charge is initiated at no other point.

21. The method defined by claim 20 wherein said case does not have an elliptical profile.

22. The method defined by claim 20 wherein said main explosive charge is simultaneously initiated at said two points by a booster explosive that is initiated at a single point.

23. A non-linear shaped charge perforator comprising:

(a) a single axisymmetric case having a hollow interior defined by (1) side walls, (2) a closed back end and (3) an open front end, wherein said closed back end and/or side walls of said case contain at least two passageways communicating with said hollow interior;

(b) a jet-producing, axisymmetric liner disposed within said axisymmetric case and closing said open front end;

(c) a main explosive charge disposed within said hollow interior between said liner and the closed back end of said axisymmetric case, wherein said main explosive charge has (1) a back conforming to and substantially flush with said closed back end (2) sides conforming to and substantially flush with said side walls and (3) a front conforming to and substantially flush with said liner; and (d) a booster explosive occupying said passageways in said single axisymmetric case and communicating with the back or sides of said main explosive charge at two initiation points located between about 165° and about 195° apart on either the back or the sides of said main explosive charge.

24. A non-linear shaped charge perforator for forming perforations in subterranean hydrocarbon-bearing formations comprising:

(a) a single axisymmetric case having a hollow interior defined by (1) side walls, (2) a closed back end and (3) an open front end;

(b) a jet-producing axisymmetric liner disposed within said axisymmetric case and closing said open front end;

(c) a main explosive charge disposed within said hollow interior between said liner and the closed back end of said axisymmetric case, wherein said main explosive charge has (1) a back conforming to and substantially flush with said closed back end (2) sides conforming to and substantially flush with said side walls and (3) a front conforming to and substantially flush with the said liner; and (e) means for initiating said main explosive charge at two locations between about 165° and about 195° apart on either the back or sides of said main explosive charge, wherein said shaped charge perforator contains no means of initiating said main explosive charge at any other location.

25. The shaped charge perforator defined by claim 24 wherein said closed back end and/or side walls of said single axisymmetric case contain two passageways communicating with said hollow interior, and said means for initiating comprises a booster explosive occupying said passageways and communicating with said main explosive charge at said two initiation locations.

26. The shaped charge perforator defined by claim 25 wherein said initiation locations are both positioned on the sides of said main explosive charge and said passageways originate at one location in the rear of said closed back end of said case and pass through said back end and said side walls to said initiation locations.

27. The shaped charge perforator defined by claim 25 wherein said initiation locations are both positioned on the back of said main explosive charge and said passageways originate at two separate locations in the rear of said closed back end of said case and pass through said closed back end to said initiation locations.

28. A perforating gun comprising a plurality of the shaped charge perforators of claim 23.

29. The perforating gun defined by claim 28 wherein said shaped charge perforators are arranged in a helical fashion on the charge tube of said perforating gun.

30. A perforating gun comprising a plurality of the shaped charge perforators of claim 24.

31. The perforating gun defined by claim 30 wherein said shaped charge perforators are arranged in a helical fashion on the charge tube of said perforating gun.

32. The shaped charge perforator defined by claim 24 wherein said means for initiating comprises a detonator cord.

33. The shaped charge perforator defined by claim 24 wherein said means for initiating comprises an electronic detonator.

* * * * *